US005974591A

United States Patent [19]

Leslie

[11] Patent Number: 5,974,591

[45] Date of Patent: Nov. 2, 1999

[54] FIREFIGHTER'S BOOT-TO-TROUSER STRAP DEVICE

[76] Inventor: Henry E. Leslie, 319 Walton Ave., San Antonio, Tex. 78225

[21] Appl. No.: 09/074,143

[22] Filed: May 7, 1998

Related U.S. Application Data

[60] Provisional application No. 60/045,928, May 7, 1997.

[51] Int. Cl.[6] ..... A41D 1/06

[52] U.S. Cl. ..... 2/323; 2/227; 2/81

[58] Field of Search ..... 2/227, 233, 304, 2/306, 323, 335, 79, 81, 312, 232, 242, 300, 912, 919, 920

[56] References Cited

U.S. PATENT DOCUMENTS 4,864,742 9/1989 Grilliot et al. ..... 2/81

4,879,769 11/1989 Grilliot et al. .

4,941,213 7/1990 Grilliot et al. ..... 2/312

*Primary Examiner*—Diana L. Oleksa

*Assistant Examiner*—Katherine Moran

[57] ABSTRACT

A system for keeping a firefighter's uniform together. Typically, firefighter's trousers can slip over the boots when the uniform is sitting together with the trousers on the boots in a "ready to use" position. In this position, the firefighter slips on the boots, pulls up the trousers and leaves to go to the fire. Applicant's system includes a strap attached to the top of the boot and fastened to the inside of the trousers so the trousers will not slip over the heel of boot and make it more difficult to get to the scene of the blaze.

7 Claims, 3 Drawing Sheets

FIREFIGHTER'S BOOT-TO-TROUSER STRAP DEVICE

This application claims the benefit of provisional application No. 60/045,928, filed May 7, 1997.

FIELD OF THE INVENTION

Footwear securing devices, more specifically, a device that will secure firefighters boots to their pants legs.

BACKGROUND OF THE INVENTION

Firefighters, because of the nature of their work, are required to use fire protective clothing. This clothing includes firefighting pants and a pair of firefighting boots. The pants and the pair of boots are only part of the total protective gear worn by the firefighter however, these parts of the gear are put on first, in a very timely manner, usually before the firefighter even boards the fire truck, leaving the remainder of the clothing and equipment to be put on en route.

Since time is a very important factor in this dressing process, the firefighter cleverly has his protective gear and equipment arranged in a strategic manner, allowing for quick and easy access in anticipation of a fire call. Included in this arrangement are the boots and the pants smartly placed next to the fire truck. This arrangement calls for the pants and the boots to be placed in relation to each other in a "ready for a call" manner (see FIG. 1). This means that the pants are at the bottom of the boots awaiting the firefighter to outfit himself by: first, stepping into his boots, and second, pulling up the pants, which are stacked over the boots (see FIG. 1). The firefighter is bound from doing anything else to outfit himself until his pants and boots are put on first, then he is free to continue dressing himself in a timely manner.

Though it is important for the firefighter to have his firefighting boots and pants placed in this "ready for a call" manner, the placement of the pants around and on the boots actually begins a process resulting in an annoying problem. This problem begins when the firefighter removes and drops his pants on and around his boots, creating a pants and boots unit placed in the "ready for a call" position (see FIG. 1). In this position, the pants and the boots are not actually connected together as a unit. Since the pants are actually dropped onto the boots, the front part of the pants are supported by the front part of the boots, leaving the rear of the pants (adjacent heel portion of boots) unsupported by the boots except by contact (friction), where the main support must be provided by the floor, or the ground. The problem begins when the firefighter, responding to a call, attempts to pick up the boots by their pull straps. To move the boots and pants together, as in FIG. 1, from one place to another, the cuffs or bottom portion of the pants finds its way under the boots and continues to travel this way until a large portion of the pants are now under the boots (and in danger of falling off the boots) (see FIG. 2).

This is very annoying to a firefighter, who must now stop everything and correct this problem before a call comes in; or who must anxiously correct this problem in response to an emergency call which has come in. Knowing that time is a factor, this is a dreadful situation for a firefighter to be in, especially if the emergency or fire scene is only minutes, sometimes only seconds, away. This problem is presently reluctantly accepted by the firefighter.

OBJECTS OF THE INVENTION

It is an object of the present invention to provide a device that will prevent pants from drooping beneath a pair of boots, the barrels of the boots on which the pants are draped, when the boots are lifted in an effort to put them on the wearer.

It is another object of the present invention to provide for a device that will prevent the bottom of pants legs, which are resting on a floor and encircling a pair of boots around the barrels thereof, from falling through the boot when the boot is raised off the floor.

SUMMARY OF THE INVENTION

These and other objects are provided for in a strap of fabric or other suitable material which has two ends, the first end for attaching to the top of the boot and the second end for attaching to the bottom of the pants legs so that, when a boot is lifted, the pants leg does not fall through the boot.

DETAILED DESCRIPTION OF THE PREFERRED EMBODIMENT

With reference to FIGS. 1–8, it is seen that the "pants lose" problem is corrected, and actually prevented, by the use of a new and practical device, a strap (10). The strap (10) is attached to the rear portion of the boots (A) in a manner which allows attachment of the strap to the pants (B) at the cuff or bottom portion of the pants (B) (see FIGS. 3–5). The strap (10) restricts the pants to a desired leg length in relation to the boots. It accomplishes this task of maintaining pant leg length in relation to the boots while at the same time allowing for movement of the pants up the barrel of the boots when needed.

Another reason that sets it apart is that it is so practical and user friendly in that it is put to use in a few short steps and detached when desired just as easily. This function is provided for in fasteners (12A), (12B) and (12C), which can be "snap-on" type, VELCRO®, or other suitable type. Fasteners (12A) and (12B) have one member on the strap and an engagement member on the boot or the pant leg, as is known in the art. In the alternative, the boot end of strap (10) may be permanently attached to the top of the boot (or the pant leg bottom) as by riveting or sewing. Here, it is seen that fastener (12A) attaches the boot end of the strap to the top of the barrel of the boot. Fastener (12B) attaches the pants end of the strap to the pants, or back to the boot end of the strap, engaging fastener (12C) to put strap (10) in a stored position. Distance (D) between boot fastener (12A) and pants fastener (12B) allows the pants to ride up in relation to the boot (for example, when sitting in the fire truck en route to an emergency, when climbing a ladder, or when climbing into a window).

Strap (10) maintains the pants at a desired level in relation to the boots while allowing upward movement of the pants when necessary, but never lets the pants become clumped or slide under the boots.

Figure 1:
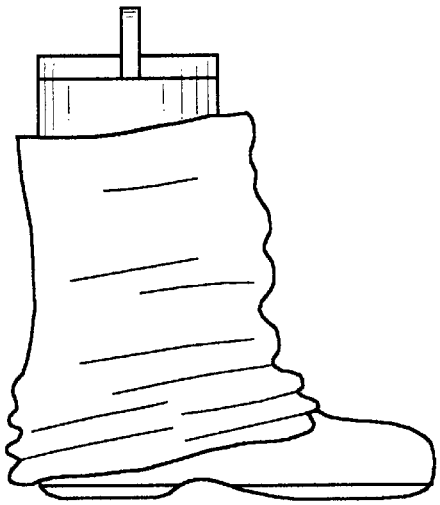
Fig. 1 (PRIOR ART)
FIG. 1 is a side elevational view of the prior art condition which Applicant's invention addresses with the boots and pants in an "at ready" or "ready for a call" condition.
Figure 2:
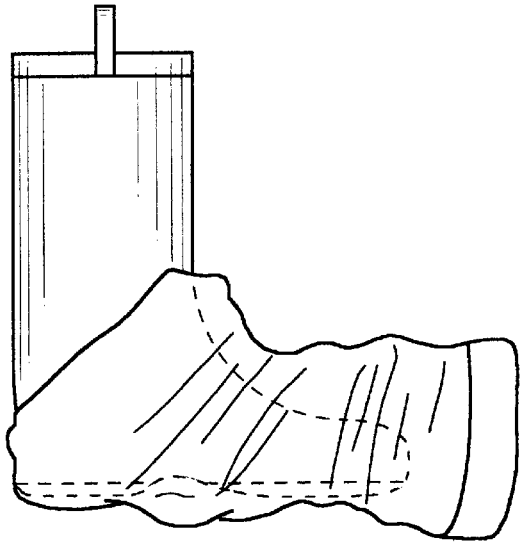
Fig. 2 (PRIOR ART)
FIG. 2 is a side elevational view of the prior art condition which Applicant's invention addresses with the pants falling through a lifted boot.
Figure 3:
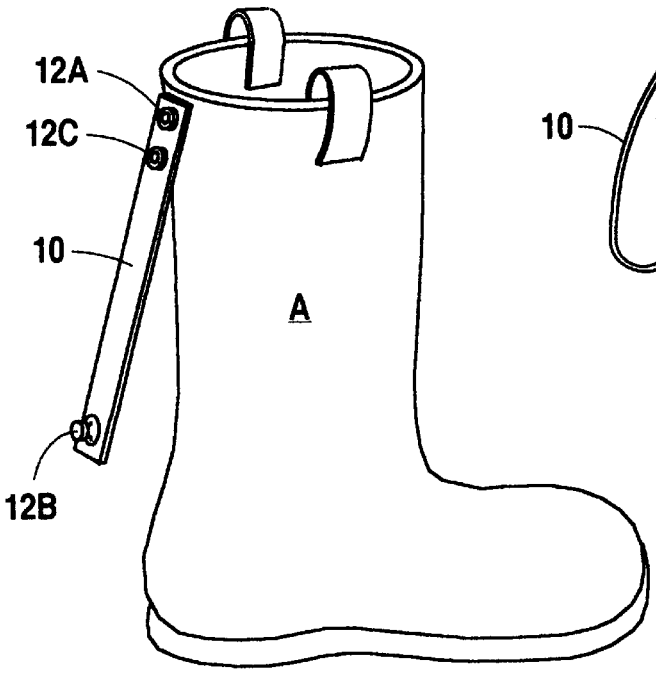
FIG. 3 is a perspective view of Applicant's present invention as attached to a boot.
Figure 4:
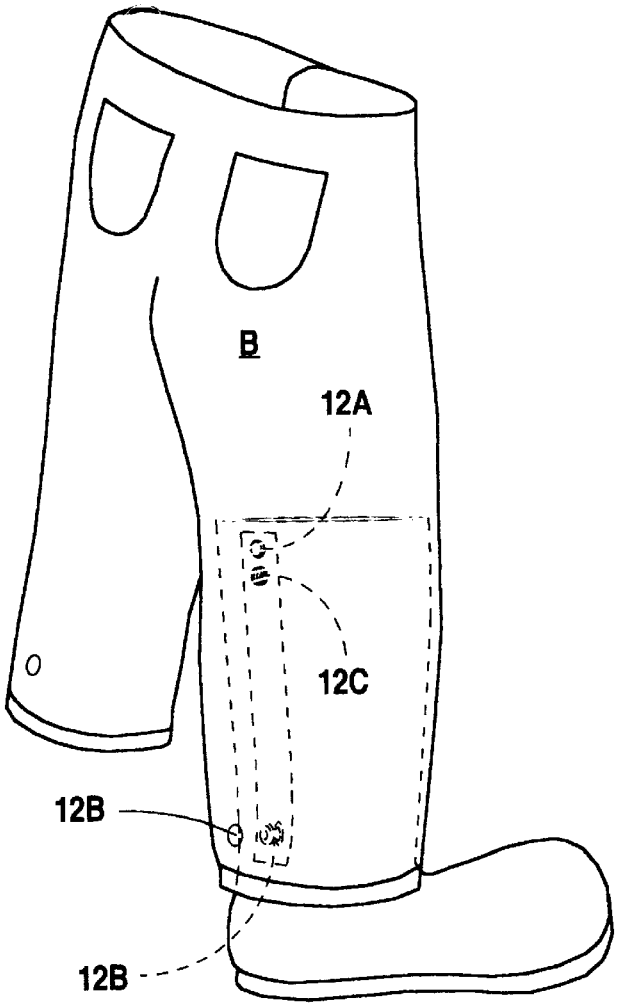
FIG. 4 is a perspective view showing Applicant's present invention attached to both the pants and a boot with the pants on the firefighter.
Figure 5:
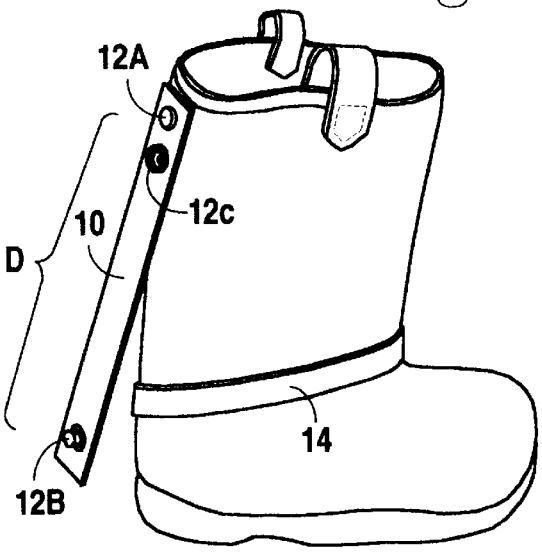
FIG. 5 is a perspective view of a firefighter's boot having Applicant's device attached thereto.
Figure 6:
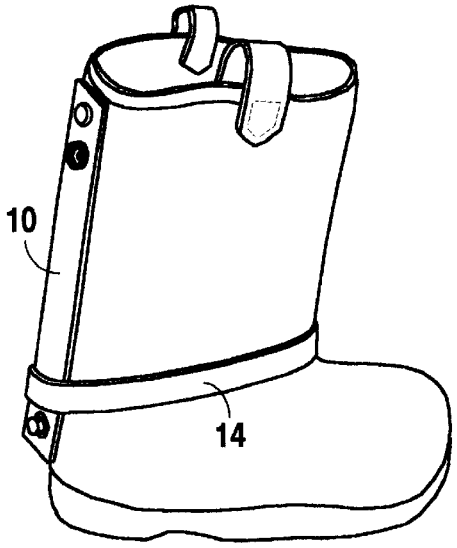
FIG. 6 is a side elevational view showing features of Applicant's present invention not illustrated in the foregoing illustrations.
Figure 7:
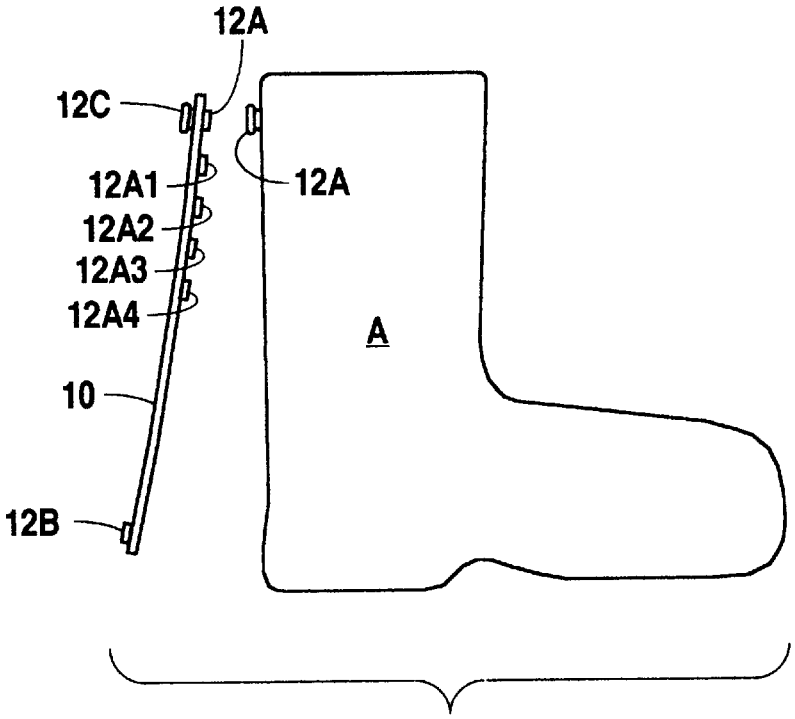
FIG. 7 is a side elevational view showing features of Applicant's present invention not illustrated in the foregoing illustrations.
Figure 8A:
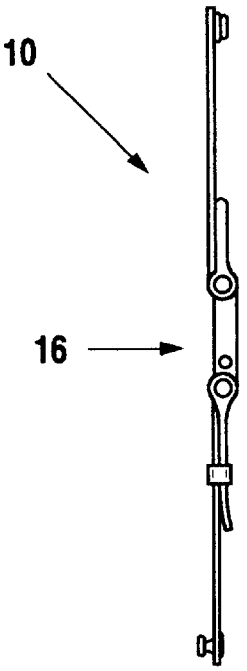
FIG. 8 is a side and front elevational view of the strap of Applicant's present invention featuring a buckle.
Figure 8B:
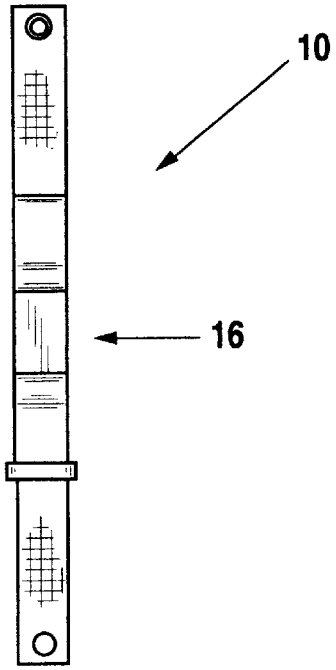

With reference to FIGS. 3 and 4, the strap (10) may be made of leather, such as Latigo leather or any other type of suitable leather or any other suitable material acceptable in the firefighting industry. A series of snap buttons or other suitable fasteners (12A1), (12A2), (12A3), and (12A4) are attached to the boot end of the strap to make it adjustable, that is, to allow the user to select the distance between the pant leg bottom and the heel of the boot. Different boots may have different length courses. Strap length adjusters, such as strap buckles (16), such as those used on firefighter helmets or motorcycle helmets, may also be used and is also part of this invention (to adjust the length of the strap) (see FIG. 8). Strap (10) may be made a standard or optional feature of the firefighting boots (permanently sewed to the boot top or removable through the use of fasteners) at the time the boots are manufactured; and the same holds true for attachment on firefighting pants at the time the pants are manufactured. However, the strap and fasteners may be retrofitted to the boots and pants through methods known in the art.

Figure 3A:
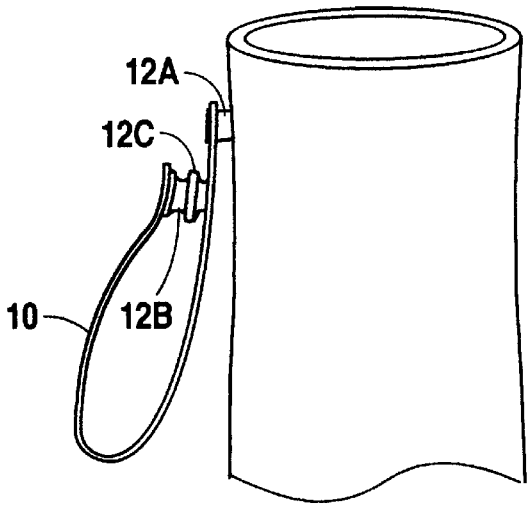
FIG. 3A is a partial view, in side elevation, of a boot having Applicant's present invention attached thereto.

Strap (10) consists of a strap-to-boot fastener, usually permanent but may be removable. Fastener (12B) is used with counterpart fastener (12C) to create a loop (see FIG. 3A) when the boots and boot strap is used with pants not equipped with fasteners or when the strap is not essential for certain duties, such as when the firefighting pants are not needed for a particular duty.

A retainer band (14) may be placed at the bottom course of the boots and may be comprised of leather or an elastic material, such as heavy rubber, or any other material suitable in the firefighting industry, to keep the strap in place when not in use. This band prevents the strap from "whipping" the boots when the strap is not in use.

Terms such as "left," "right," "up," "down," "bottom," "top," "front," "back," "in," "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

What is claimed is:

1. A system for keeping parts of a firefighter's uniform together, system comprising:

a firefighter's boot, the boot having a barrel with a top edge, and a heel, the fire fighter's boot including first attachment means adjacent to top edge thereof;

a firefighter's protective trousers, the trousers having a pant leg with a pant leg bottom, the firefighter's protective trousers including second attachment means near the pant leg bottom;

a strap, the strap having a first end and a second end, the first end including first fastener means thereon for engaging the first end of said strap to the first attachment means of said boot, the strap also including second fastener means for attaching the second end of the strap to the second attachment means of the firefighter's protective trousers;

wherein at least one of said first fastener means and said second fastener means is releaseable and wherein the length of the strap is dimensioned to prevent, when attached to the top of the boot and the pant leg bottom, the pant leg from slipping past the heel of the boot.

2. The system of claim 1 further including a retainer band dimensioned to fit about the barrel of the boot for retaining said strap adjacent to boot when said strap is not in use.

3. The system of claim 1 where the first attachment means includes a means to releaseably attach the strap to the boot.

4. The system of claim 1 wherein the first attachment means of the firefighter's boot include a means to permanently attach the strap to the boot.

5. The system of claim 1 wherein the strap includes means to adjust the length of the strap.

6. The system of claim 1 wherein the second fastener means of the strap includes a snap and wherein the second attachment means of the firefighter's protective trousers includes a snap engageable with the second fastener means.

7. The system of claim 1 wherein the first attachment means of the firefighter's boot includes a snap and wherein the first fastener means of the strap includes a series of snaps engageable with the snap of the first attachment means of the boot to adjustably set the length between the two fastener means of the strap.

* * * * *